United States Patent [19]

Williams et al.

[11] Patent Number: 5,013,162

[45] Date of Patent: May 7, 1991

[54] FLEXIBLE-WALLED SECURITY CONTAINERS

[75] Inventors: George W. Williams, Nanticoke; Arnold S. Rifkin, Wilkes-Barre, both of Pa.

[73] Assignee: A. Rifkin Co., Wilkes Barre, Pa.

[21] Appl. No.: 565,381

[22] Filed: Aug. 9, 1990

[51] Int. Cl.[5] ..... B65D 33/16; E05B 67/38

[52] U.S. Cl. ..... 383/97; 190/120; 70/68

[58] Field of Search ..... 383/5, 71, 97; 190/120; 150/101, 102; 70/68

[56] References Cited

U.S. PATENT DOCUMENTS

| | | | |
|---|---|---|---|
| 1,759,283 | 5/1930 | Schmidt | 70/68 |
| 1,759,284 | 5/1930 | Schmidt | 70/68 |
| 1,950,414 | 3/1934 | Rifkin | 70/68 |
| 1,950,415 | 3/1934 | Rifkin | 70/68 |
| 3,653,236 | 4/1972 | Kerr | 70/68 |
| 3,759,073 | 9/1973 | Rifkin | 70/68 |
| 4,661,990 | 4/1987 | Rifkin | 383/97 |
| 4,744,230 | 5/1988 | Shum | 70/68 |

*Primary Examiner*—Stephen P. Garbe
*Assistant Examiner*—Jes F. Pascua
*Attorney, Agent, or Firm*—Panitch, Schwarze, Jacobs & Nadel

[57] ABSTRACT

A flexible-walled security container has an opening provided with a fastener slidable along edges of the opening and a locking mechanism to releasably retain the slider in a position closing the container. The locking mechanism includes a body supporting a receiver with a recess in an upper surface thereof to receive the slider and a retainer closable on the received slider. Lugs at one end of the recess prevent slide removal of the slider. Gaps are formed along the upper surface between the lugs and a supporting wall of the body. A clip is provided to snap onto the receiver. Arms of the clip cover the gaps between the lugs and the supporting wall of the body. The clip is configured to conform closely to the receiver so as not to protrude discernably into the container.

19 Claims, 1 Drawing Sheet

FLEXIBLE-WALLED SECURITY CONTAINERS

FIELD OF THE INVENTION

The invention relates to flexible-walled security containers and, in particular, to improvements assuring the secured integrity of such containers.

BACKGROUND OF THE INVENTION

Flexible-walled security containers are typically employed by banks and other institutions for carrying valuables. The type of container to which the present invention particularly pertains is disclosed, for example, in prior U.S. Pat. No. 3,759,073.

The security container disclosed in that patent includes a flexibly walled bag open along one or more sides and having a slide fastening closure along the opening. The container is equipped with a locking mechanism which includes a body 11 located in the bag and having a receiver or jaw 20 that receives a slider 28 of the closure when the slider closes the opening of the bag. Receiver 20 extends from an inner end surface 13 of the body 11 and is provided with a generally horseshoe-shaped recess 22. A necked passageway 25 is provided from the recess through one end 24 of the receiver to receive the slider 28 of the fastener. The recess 22 and necked passageway 25 are shaped to conformably receive and retain the slider. A retainer 32 is supported on the body 11 and includes a plate 33 movable towards and away from the recess 22. The plate 33 can be locked down on top of the slider 28 when the slider is positioned in the recess 22. A pair of lugs 30 on opposing sides of the passageway 25 project upwardly from the receiver 20 towards the plate 33. The lugs 30 are intended to prevent removal of the slider 28 from the recess 22 without raising the slider above the lugs.

Gaps were provided between the lugs 30 and the inner end surface 13 of the body 11, above the upper surface 22 of the receiver 20. It was originally thought that these gaps would assist in permitting the engagement of the slider 28 in the recess 22 without criticality as to the slider position, for speed, convenience and ease of operation. Instead, it has been found that the presence of these gaps is not particularly critical to the positioning of the slider in or its removal from the recess 22. These gaps are the largest remaining openings in the locking mechanism which surrounds the slider when the slider is secured in the recess.

It would be desirable to provide a means to essentially cover and fill these gaps so as to more completely surround the slider/fastener with the locking mechanism, further limiting access to interior areas of the locking mechanism and protecting and concealing the slider.

It further would be desirable to provide a means to retrofit containers of the type disclosed, for example, in U.S. Pat. No. 3,759,073, with a relatively simple device which can be easily manufactured and simply attached to the receiver of an existing container to avoid modifications to the existing container.

SUMMARY OF THE INVENTION

The invention is an improvement in a security container having a pair of flexible walls, an opening between edge margins of the walls, fastener means including a slider shiftable along the edge margins of the walls for opening and closing the opening, a body fixed generally interiorly of the container adjacent to the opening, and a retainer shiftably carried by the body generally exteriorly of the container. The body includes a receiver extending transversely from an inner end surface of the body in a direction generally along the opening. The receiver includes an upper surface facing generally outwardly through the opening, a lower surface on a side of the receiver opposite the upper surface, and an outer end surface connecting the upper and lower surfaces. The receiver further includes a recess in the upper surface with a reduced-width passageway extending through the outer end surface for receiving the slider in the recess through the outer end surface. The receiver further includes a pair of lugs extending generally outwardly from the upper surface towards the opening on opposing sides of the passageway. The lugs are spaced from the inner end surface whereby gaps are formed on opposing sides of the upper surface between the lugs and the inner end surface. The retainer includes a member extending generally in a direction along the opening and having one side facing inwardly through the opening towards the recess and the lugs. The retainer member is shiftable towards and away from the recess to releasably retain the slider in the recess and to cover portions of the bag edge margins adjoining the slider. The improvement comprises a clip adapted for removable attachment to the receiver. The clip includes a base and a pair of arms extending generally transversely from the base sufficiently to substantially cover the gaps between the lugs and the inner end surface when the base is facing the lower surface of the receiver. The invention further includes the combination of the improvement clip with the flexible-walled container.

The invention further comprises a clip for a flexible-walled security container comprising: a base; and a pair of arms integral with the base and extending transversely from the base to one side of the base from a pair of opposing edges of the base, extreme ends of the arms being turned inwardly in a manner providing each arm with a short side and a long side. Portions of the inwardly turned ends are doubled to project transversely from the turned ends and generally away from the base.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
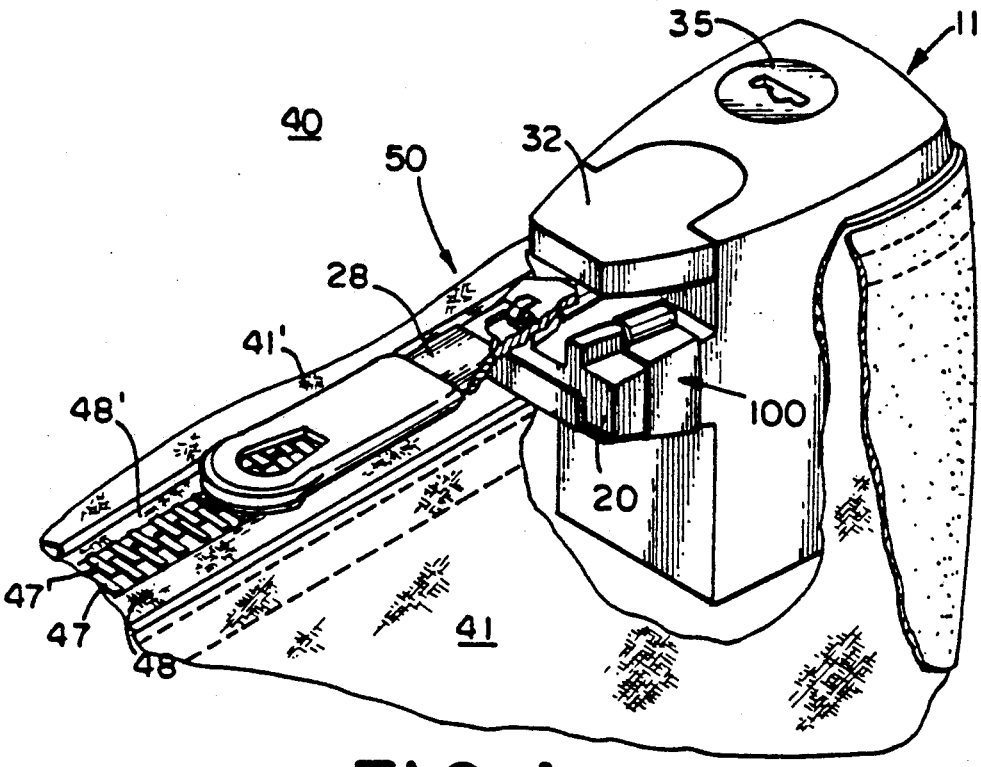
FIG. 1 is a partially broken-away isometric view of the locking means of a flexible-walled security container illustrating the improvement of the present invention.

Referring to the drawings, like numerals are employed for the indication of like elements. The present invention relates to improvements in flexiblewalled security containers. The preferred security container is that disclosed in U.S. Pat. No. 3,759,073, which is incorporated by reference herein in its entirety. To the extent possible, the same reference numbers are used in the present application to refer to the same elements referred to in that patent.

Referring to the drawings, the preferred flexible-walled security container of the present invention is indicated generally at 40 and includes a pair of flexible walls 41 and 41', edge margins of which are indicated generally at 47 and 47'. The edge margins 47, 47' are provided by flexible slide fastener tapes indicated at 48 and 48', respectively. In addition to forming the edge margins, tapes 48 and 48' comprise parts of a slide fastener means indicated generally at 50. An opening is provided between the edge portions 47 and 47' when the teeth of the tapes 48 and 48' are disengaged. The fastener means 50 further includes a slider 28 shiftable along the tapes 48, 48' and edge margins 47, 47' to open and close the opening.

The container 40 further includes a block-like body, which is indicated generally at 11 and fixed generally interiorly of the container 40 adjacent an end of the opening, and a retainer which is indicated generally at 32 and is shiftably carried on the body 11 generally exteriorly of the container 40. Body 11 includes a receiver or jaw 20 extending transversely from an inner end surface 13 of the body 11 in a direction generally along the opening. The receiver 20 includes an upper surface 21 facing outwardly through the opening, a lower surface 21' on a side opposite the upper surface 21, an outer end surface 24 connecting the upper and lower surfaces 21, 21', and a recess 22 in the upper surface 21. The recess 22 is generally horseshoe shaped and is provided with a reduced width passageway, indicated generally at 25, which extends through the outer end surface 24 for receiving the slider 28 in the recess 22 through the outer end surface 24. The receiver 20 further includes a pair of lugs 30 extending outwardly from the upper surface 21 towards the opening on opposing sides of the passageway 25. The lugs are spaced from the inner end surface 13 whereby gaps, indicated generally at 120, are formed on opposing sides of the upper surface 21 between the lugs 30 and the inner end surface 13. Retainer 32 is shiftably carried on the body 11 by means of a shank or slide 34. The retainer 32 includes a plate member portion 33 which extends generally in a direction along the opening and has one side face 32', which is hidden in the figures and which faces inwardly through the opening towards the recess 22 and lugs 30. The retainer plate member portion 33 is thus shiftable towards and away from the recess 22 to releasably retain the slider 28 in the recess 22, in the manner indicated in FIG. 1, and to cover portions of the tapes 48, 48' at the edge margins 47, 47' which adjoin the slider 28. The portions of the edge margins 47, 47' covered by the retainer plate member 33 are accessible through the gaps 120 between the lugs 30 and the inner end surface 13. The retainer 32 can be maintained in the lowered, locking position depicted in FIG. 1 and released therefrom by means of a rotary lock plug 35 provided in the body 11.

Figure 2:
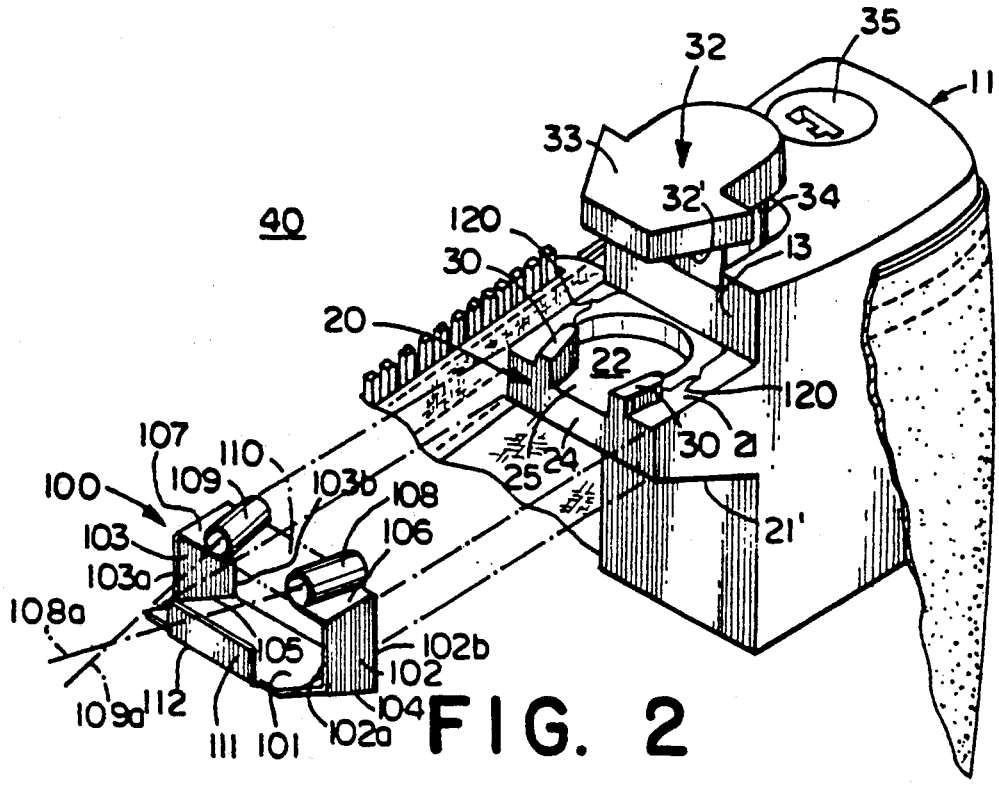
FIG. 2 is a view similar to FIG. 1 with the security container open and the improvement clip of the present invention removed from the body of the locking means.

The improvement of the present invention is the provision of a clip which is indicated generally at 100 in the figures and is mounted to the receiver 20 covering the gaps 120. Referring particularly to FIG. 2, the clip includes a base 101 and a pair of arms 102 and 103 integral with the base 101 extending generally transversely from the base 101, in the same direction, from a pair of opposing edges 104 and 105 of the base. Extreme ends of the arms, distal to the base 101 and indicated at 106 and 107, are turned inwardly and preferably generally form a plane which is indicated in phantom at 110. Plane 110 is generally non-parallel with the plane of the base 101 whereby each arm 102 and 103 has a short side **102*a*, 103*a* and a long side 102*b*, 103*b*. Portions 108 and 109 of the inwardly turned ends 106 and 107 are doubled over, preferably by being rolled as indicated, to project generally transversely from the ends 106, 107, from the plane 110 defined by the ends 106 and 107 as well as from the plane of base 101. Each of the rolled portions 108 and 109 includes a central axis 108*a* and 109*a*, respectively. The axes 108*a* and 109*a* are generally converging towards one side of the clip 100. Preferably, clip 100 further comprises a flange portion 111 turned transversely to the base 101 in generally the same transverse direction of the arms 102, 103. Flange portion 111 forms a third edge 112 of the base 101 on one side of the clip 100 between the pair of edges 104 and 105 formed by the arms 102 and 103. Referring back to FIG. 1, arms 102 and 103 with rolled portions 108 and 109 extend transversely from the base 101 sufficiently to cover the gaps 120 between lugs 30 and inner end surface 13, as is indicated in FIG. 1, when the base 101 is facing the lower surface 21' of the receiver 21. Preferably, the clip 100** is cut and formed from a hardened spring steel.

Use of the clip 100 will now be explained first with reference to FIG. 2. The clip 100 is positioned at the extreme projecting end of the receiver 20 adjoining the outer surface 24 with the base 101 beneath that surface and the turned edge portions 106 and 107 on or above the upper surface 21. The clip 100 may then be pressed onto the receiver 20 by applying pressure to the flange 111, which acts as a finger member. The rolled portions 108 and 109 are angled similarly to the angulation of the lugs 30 around the horseshoe-shaped recess 22 so as to effectively continue the extension of those lugs towards the inner end wall 13 (as best seen in FIG. 1). The arms 102 and 103 will eventually be cammed outwardly by contact of the rolled portions 108 and 109 with the lugs 30 as those portions pass the lugs 30. The arms 102 and 103 will snap back to the position indicated in FIG. 1 when the turned ends 106 and 107 have cleared the lugs 30. The rolled portions 108 and 109 substantially cover the gaps 120 between the lugs 30 and the inner end surface 13 when base 101 is facing the lower surface 21' of the receiver 20. Preferably, the clip 100 fits closely to the receiver 20 with the base 101 parallel to and adjoining the lower surface 21', the turned ends 106 and 107 extending onto and resting against the upper surface 21 with rolled portions 108 and 109 of those arms extending into the gaps 120 and the flange portion 111 resting against the outer end surface 24 of the receiver 20 so that the clip 100 does not discernibly protrude anywhere from the receiver 20 into the remainder of the container 40.

The securable container 40 with clip 100 operates in the same way as the securable container disclosed in the aforesaid U.S. Pat. No. 3,759,073. However, the clip 100 now substantially covers the gaps 120 further limiting access to the interior spaces of the locking mechanism and protecting and concealing the slider.

The clips 100 are relatively easy and inexpensive to manufacture. Clips 100 provide a relatively inexpensive and easy way to retrofit existing containers 40 having the indicated gaps 120 which require no modification of those containers.

It will be recognized by those skilled in the art that changes could be made to the above-described embodiments of the invention without departing from the broad inventive concepts thereof. It should be understood, therefore, that the invention is not limited to the particular embodiments disclosed, but is intended to cover any modifications which are within the scope and spirit of the invention, as defined by the appended claims.

We claim:

1. In a security container having a pair of flexible walls, an opening between edge margins of the walls, fastener means including a slider shiftable along the edge margins of the walls for opening and closing the opening, a body fixed generally interiorly of the container adjacent to the opening, and a retainer shiftably carried on the body generally exteriorly of the container, the body including a receiver extending transversely from an inner end surface of the body in a direction generally along the opening, the receiver including an upper surface facing generally outwardly through the opening, a lower surface on a side of the receiver opposite the upper surface, an outer end surface connecting the upper and lower surfaces and a recess in the upper surface with a reduced-width passageway extending through the outer end surface for receiving the slider in the recess through the outer end surface, the receiver further including a pair of lugs extending generally outwardly from the upper surface towards the opening on opposing sides of the passageway, the lugs being spaced from the inner end surface whereby gaps are formed on opposing sides of the upper surface between the lugs and the inner end surface, the retainer including a member extending generally in a direction along the opening and having one side facing inwardly through the opening toward the recess and the lugs, the retainer member being shiftable towards and away from the recess to releasably retain the slider in the recess and to cover portions of the bag edge margins adjoining the slider, the improvement comprising a clip adapted for removable attachment to the receiver, the clip including a base and a pair of arms extending generally the same direction transversely from the base sufficiently to substantially cover the gaps between the lugs and the inner end surface when the base is facing the lower surface of the receiver.

2. The improvement of claim 1 wherein extreme ends of the arms of the clip, distal to the base, are inwardly turned so as to extend onto the upper surface and into the gaps.

3. The improvement of claim 2 wherein portions of the inwardly turned ends of the arms are doubled over.

4. The improvement of claim 3 wherein the doubled over portions of the inwardly turned ends of the arms are rolled.

5. The improvement of claim 3 wherein central axes of the doubled-over portions are generally converging towards one side of the clip.

6. The improvement of claim 1 wherein the clip further includes finger means extending from a side of the base between the arms in a direction transverse to the base for pressing the clip onto the receiver.

7. The improvement of claim 1 wherein the finger means extends in generally the same transverse direction as the arms.

8. The improvement of claim 1 comprising the combination of the clip and the container.

9. The improvement of claim 2 comprising the combination of the clip and the container.

10. The improvement of claim 3 comprising the combination of the clip and the container.

11. The improvement of claim 4 comprising the combination of the clip and the container.

12. The improvement of claim 5 comprising the combination of the clip and the container.

13. The improvement of claim 6 comprising the combination of the clip and the container.

14. The improvement of claim 7 comprising the combination of the clip and the container.

15. The combination of claim 8 wherein the receiver lower surface slopes transversely to the upper surface and wherein the clip base slopes transversely to the arms to conform to the slope of the receiver lower surface.

16. A clip for a flexible-walled security container comprising:

a base; and a pair of arms integral with the base and extending transversely from the base to one side of the base from a pair of opposing edges of the base, extreme ends of the arms being turned inwardly in a manner providing each arm with a short side and a long side, portions of the inwardly turned ends being doubled to project transversely from the turned ends and generally away from the base.

17. The clip of claim 16 wherein the doubled portions are rolled.

18. The clip of claim 16 wherein central axes of the rolled portions are generally converging towards one side of the clip.

19. The clip of claim 16 further comprising a flange portion turned transversely to the base from a third edge of the base between the pairs of edges.

* * * * *